US006540505B1

(12) United States Patent
Wuest et al.

(10) Patent No.: US 6,540,505 B1
(45) Date of Patent: Apr. 1, 2003

(54) BURNER FOR LIQUID FUEL

(75) Inventors: Josef Wuest, Steinhausen (CH); Heinz Steiner, Lohn-Ammannsegg (CH)

(73) Assignee: Toby AG, Solothurn (CH)

( * ) Notice: Subject to any disclaimer, the term of this patent is extended or adjusted under 35 U.S.C. 154(b) by 0 days.

(21) Appl. No.: 09/786,222

(22) PCT Filed: Aug. 13, 1999

(86) PCT No.: PCT/CH99/00376

§ 371 (c)(1),
(2), (4) Date: Mar. 1, 2001

(87) PCT Pub. No.: WO00/12935

PCT Pub. Date: Mar. 9, 2000

(30) Foreign Application Priority Data

Sep. 1, 1998 (CH) ..... 1783/98

(51) Int. Cl.[7] ..... F23D 13/14; F23D 7/00

(52) U.S. Cl. ..... 431/78; 431/328; 431/208; 431/75; 431/215; 431/207; 431/243

(58) Field of Search ..... 431/208, 168, 431/266, 202, 215, 328, 331, 329, 354, 207, 326, 25, 243, 77, 75, 80, 7, 78

(56) References Cited

U.S. PATENT DOCUMENTS

| | | | | | |
|---|---|---|---|---|---|
| 3,734,677 | A | * | 5/1973 | Murase et al. | 431/208 |
| 4,045,159 | A | | 8/1977 | Nishi et al. | |
| 4,265,614 | A | | 5/1981 | Satoda et al. | |
| 4,280,806 | A | * | 7/1981 | King | 431/208 |
| 4,303,055 | A | * | 12/1981 | Fixler | 126/93 |
| 4,392,813 | A | * | 7/1983 | Tanaka et al. | 431/201 |
| 4,473,349 | A | * | 9/1984 | Kumatsu | 431/116 |
| 4,504,215 | A | * | 3/1985 | Akiyama et al. | 431/168 |
| 4,543,055 | A | * | 9/1985 | Tilly | 431/12 |
| 4,545,758 | A | * | 10/1985 | Nakamura et al. | 126/149 |
| 4,624,631 | A | * | 11/1986 | Kobayashi et al. | 431/116 |
| 4,710,125 | A | * | 12/1987 | Nakamura et al. | 126/93 |
| 4,712,997 | A | * | 12/1987 | Fullemann et al. | 239/214.25 |
| 5,328,355 | A | * | 7/1994 | Kobayashi et al. | 431/10 |
| 5,346,391 | A | | 9/1994 | Fullermann et al. | |

FOREIGN PATENT DOCUMENTS

| | | | | |
|---|---|---|---|---|
| DE | 25 34 066 | | 2/1976 | |
| DE | 37 09 830 | | 10/1988 | |
| DE | 41 26 745 | | 2/1992 | |
| EP | 558 455 | | 9/1993 | |
| FR | 2 733 579 | | 10/1996 | |
| JP | 58031208 A | * | 2/1986 | F23D/11/02 |

* cited by examiner

*Primary Examiner*—Henry A Bennett
*Assistant Examiner*—Kathryn Ferko
(74) *Attorney, Agent, or Firm*—Cohen, Pontani, Lieberman & Pavane

(57) ABSTRACT

A burner for liquid fuel has an electric heating device for start up heating a fuel vaporization chamber to a selected temperature, a flame retention baffle being fitted on the vaporization chamber with a temperature sensor sensing temperature of the vaporization. When the vaporization chamber is heated to a desired temperature of about 350 degrees celsius by deflected hot exhaust gas products from the burner operation and such temperature is sensed, the sensor outputs a signal so that the electric heating device can be shut down, vaporization chamber heating then being maintained by the deflected hot exhaust gas flow.

17 Claims, 4 Drawing Sheets

BURNER FOR LIQUID FUEL

This is a U.S. national stage of application No. PCT/CH99/00376, filed on Aug. 13, 1999. Priority is claimed on that application and on the following application:

Country: Switzerland, Application No.: 1783/98, Filed: Sep. 01, 1998.

The invention relates to a burner with which liquid fuel is burned and, an electric heating device being used at startup for heating a fuel vaporization chamber, hot exhaust gases from burner operation being used to heat the vaporization chamber from the outside so that when a desired vaporization temperature is reached, the electric heating device can be shut down.

Such burners are advantageously used in heating systems for residential and non-residential buildings. The heat produced by the burner during the combustion of the fuel heats, for example, water in a heating boiler. In addition to burners for liquid fuels, such as heavy oil, extra light heating oil or kerosene, there are burners for gaseous fuels such as natural gas. The latter are distinguished in particular by the fact that their generation of heat can be controlled over a large output range, which in the technical world is designated modulation capacity. In addition, gas burners have favorable values with regard to pollutant emissions.

Burners for liquid fuels are widespread. Whereas burners for heavy oil are used in furnaces of industrial plants, burners for light heating oil, in particular such heating oil of the type "extra light heating oil", predominate in heating systems in residential and non-residential buildings. In this case, atomizer burners are widespread, in which the heating oil delivered by an oil pump is atomized by means of a nozzle and directly burned. Such burners can only be modulated starting from higher outputs, e.g. greater than 100 kW. On account of constructional measures such as better insulation of buildings, the specific heat requirement has decreased in the last two decades. Atomizer burners are only suitable for heating systems having a rated output of 15 kW and above. If the heat requirement is lower, which is the case in newer houses for example, the burner must be switched on and off continuously, that is to say it has to run in so-called cyclic operation. However, it is known that every switch-on action is associated with an increased pollutant emission, so that less favorable emission values result overall.

For the aforesaid reasons, the relevant industry has created so-called vaporizing burners. In these burners, the fuel is vaporized by the effect of heat and then mixed with air and burned. Such burners were to begin with used mainly for the combustion of kerosene or petroleum, since these fuels have a relatively low vaporization temperature. With kerosene or petroleum as fuel, it is possible, during burner start-up, to heat the kerosene or petroleum to the vaporization temperature in the vaporizing chamber by means of an electric heating device, but to subsequently switch off the electric heating device when the heating device together with the burner has been heated up to such an extent that the vaporization of the kerosene or petroleum is maintained by the sensible heat of the heating device. With extra light heating oil, however, continuous operation of the electric heating device is necessary on account of the much higher vaporization temperature with this fuel.

FR-A1-2 733 579 discloses a burner intended for the combustion of kerosene, in which case it is questionable whether it might also be suitable for extra light heating oil. It contains the electric heating device already mentioned, which is switched on when a temperature sensor indicates the need for preheating. It cannot be clearly recognized whether it also switches off the preheating again after the burner start-up. Since the temperature sensor is also not shown, it also cannot be clearly recognized where and how it should be arranged.

DE-A1-25 34 066 discloses a burner which is more suitable for burning extra light heating oil. It contains the electric heating device already mentioned. It serves not only to heat the fuel but also to heat the air required for the combustion, so that the fuel already vaporized is prevented from condensing again. Inadequate heating would lead to the fuel not burning in a clean manner but partly carbonizing, which leads to malfunctioning after a short time.

It is also known (DE-A1-41 26 745) to first of all atomize the fuel by means of a nozzle in order to subsequently vaporize it by means of an electric heating device.

The object of the invention is to provide a burner which is suitable for burning extra light heating oil and in which the vaporizing chamber has to be heated by means of the above-mentioned electric heating device only during the starting phase when the burner is cold, whereas the supply of external energy for heating the fuel is unnecessary during the subsequent operation of the burner.

In accordance with the invention, a burner for liquid fuel is provided with an electric heating device for start up heating fuel vaporization chamber to a selected temperature, the vaporization chamber having a fuel atomization element therein. A flame retention baffle is fitted on the vaporization chamber, and a temperature sensor is provided for sensing temperature of the vaporization chamber. A fan supplies an air flow through the vaporization chamber and vaporized fuel mixes therewith and is ignited producing a flow of hot exhaust gases. At least a portion of the hot exhaust gases is deflected so that said deflected hot exhaust gases portion will heat up the vaporization chamber from the outside. When the vaporization chamber is heated to a desired temperature of about 350 degrees Celsius by the deflected hot exhaust gases from the burner operation and such temperature is sensed by the sensor the sensor outputs a signal so that the electric heating device can be shut down, vaporization chamber heating then being maintained by the deflected hot exhaust gas flow.

Exemplary embodiments of the invention are explained in more detail below with reference to the drawing, in which.

Figure 1:
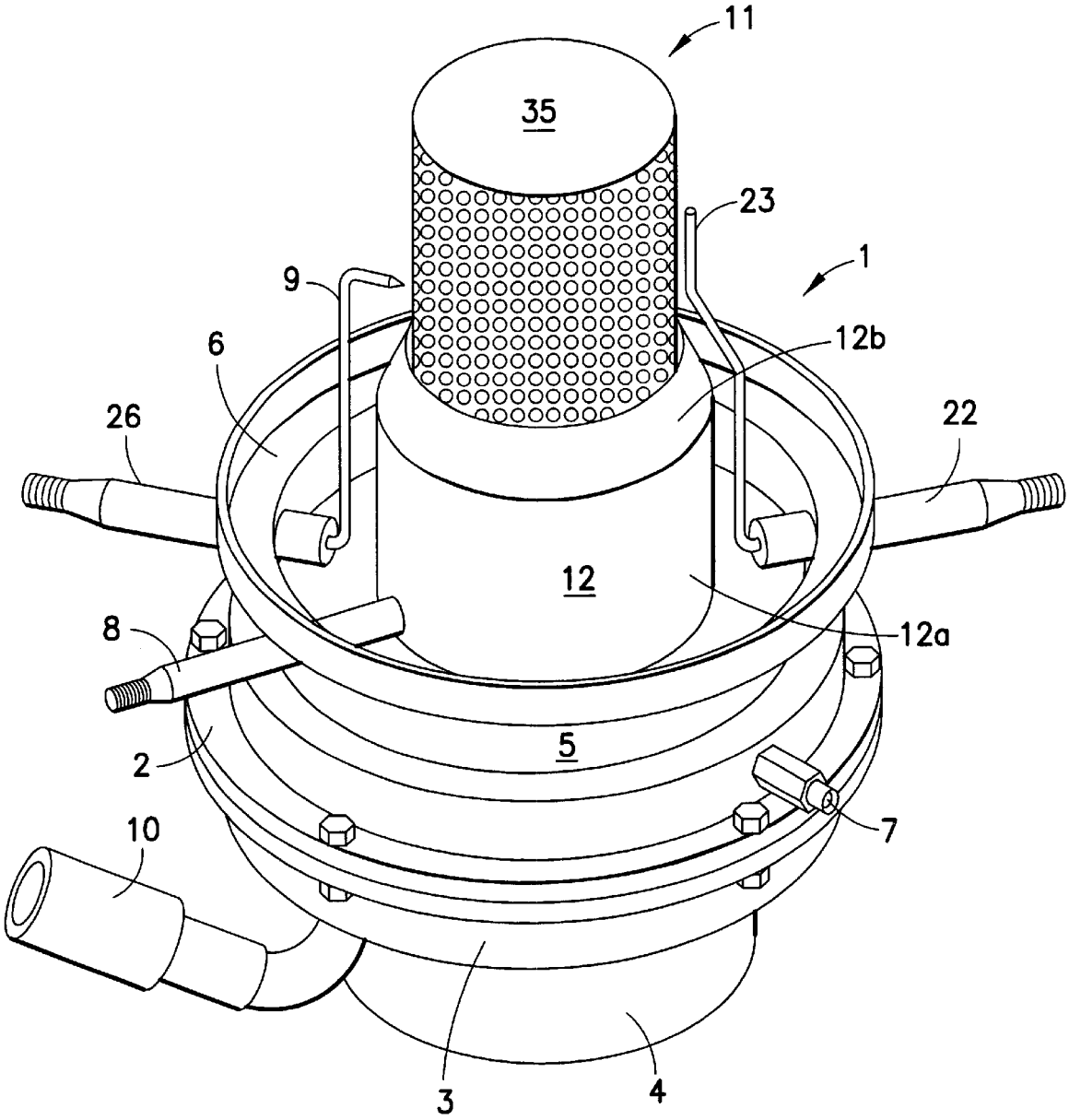
FIG. 1 shows a view of a burner.

Designated by 1 in FIG. 1 is a burner which has a fan 3 which is held by a flange 2 and to which fresh air can be fed through a connection tube 10. Arranged below the fan 3 is a motor 4, which drives the fan 3. Mounted on the fan 3 is a burner pot 5, which is provided on its top side with a connection flange 6, with which the burner 1 can be mounted from below on a heating boiler (not shown). A fuel connection 7 is provided at the top on the fan 3. The heating oil is fed here to the burner 1. From the fuel connection 7, the heating oil passes via a fuel line (not shown in this view) into a vaporizing chamber (likewise not shown in this view). Mounted in the wall of the burner pot 5 is a temperature sensor 8, which, in combination with a controller (not shown), serves to control the electric heating device already mentioned at the beginning. In addition, a first holder 26 which serves to accommodate an ignition device, for example an ignition electrode 9 or an incandescent igniter, passes through the wall of the burner pot 5. The ignition electrode 9 serving to ignite the fuel/air mixture is designed in such a way that its one end projects into that region of the burner 1 in which the flame is to arise. This region is provided for by a cylindrical flame retention baffle 11, which projects from a deflection collar 12 and which is closed at its top side with a cover 35. The deflection collar 12 consists of a cylindrical part 12*a* and an adjoining inclined shoulder 12*b*. The flame retention baffle 11 is put onto the vaporizing chamber (not shown in this representation). It is advantageously made of heat-resistant steel or ceramic. The deflection collar 12 is advantageously made of heat-resistant steel sheet, if need be also of cast steel.

Furthermore, FIG. 1 shows an electrode 23 which is fastened in the wall of the burner pot 6 by means of a further holder 22. The free end of this electrode 23 lies at a certain distance from and parallel to the surface of the flame retention baffle 11. The electrode 23 belongs to an ionization measuring device (not shown) with which the presence of a flame can be monitored. This monitoring is effected by a burner control unit which is assigned to the burner 1 but not shown here and controls and monitors the start and operation of the burner 1 as in the prior art.

Figure 2:
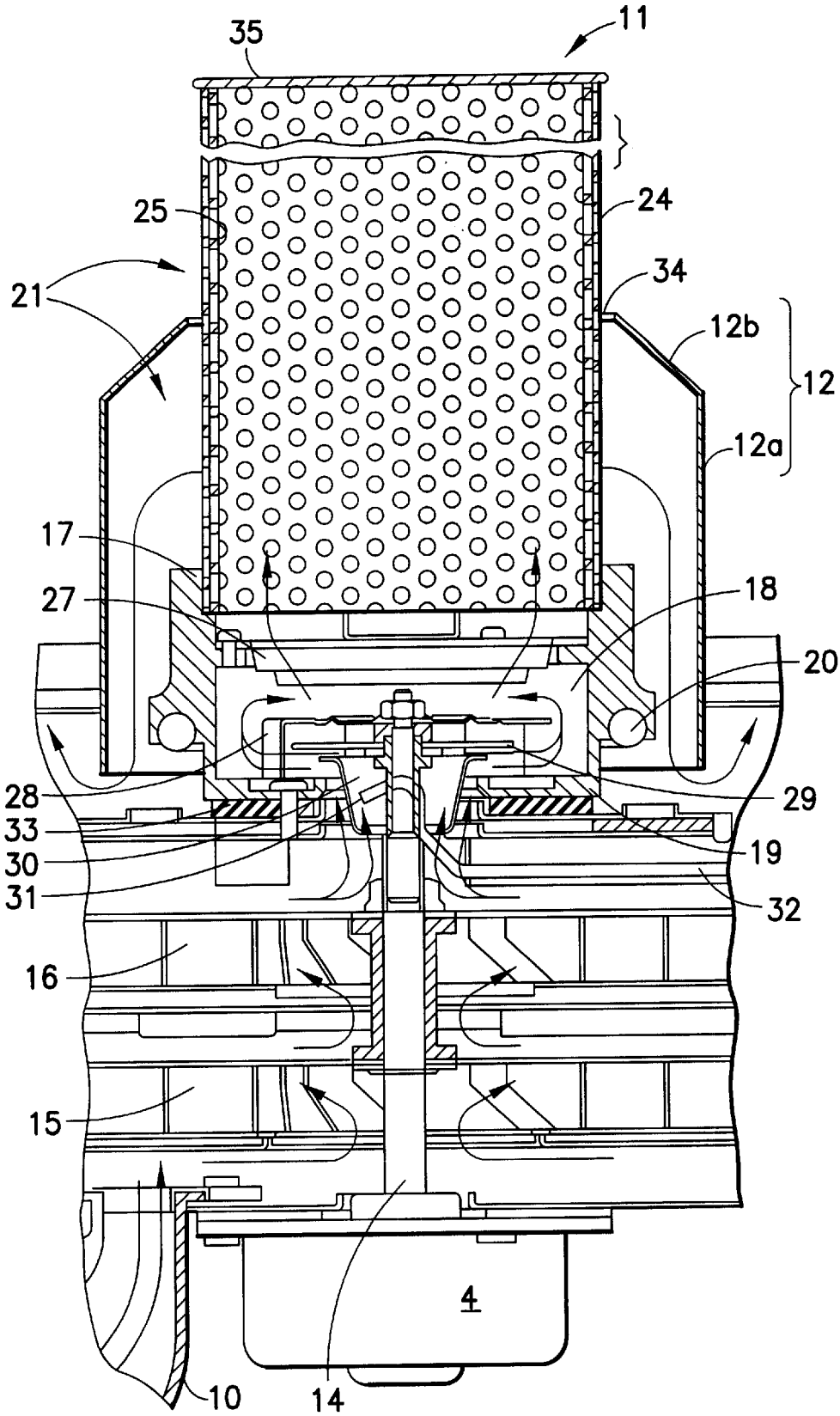
FIG. 2 shows a vertical section of a first embodiment of the burner.

FIG. 2 shows a vertical section through the burner 1 shown in FIG. 1, from which more details can be seen. A first embodiment of the burner 1 is shown in this case. The motor 4 which drives the fan 3 (FIG. 1) can be seen in the bottom part of FIG. 2. Of the fan 3, only a drive shaft 14 common to the motor 4 and fan 3 can be seen in this representation, a first rotor 15 and a second rotor 16 being fastened to this drive shaft 14. Fresh air is delivered by the rotors 15, 16, the delivery direction being identified by arrows.

The flame retention baffle 11 with its cover 35 can be seen in the top part of FIG. 2, and it can also be seen that the flame retention baffle 11 sits on a vaporizing chamber 17 already mentioned in connection with FIG. 1. The vaporizing chamber 17 is closed at the bottom by a base 19. The space enclosed by the vaporizing chamber 17 and its base 19 forms a mixing and vaporizing zone 18. An electric heating device 20 is integrated in the wall of the vaporizing chamber 17.

The flame retention baffle 11 is surrounded by a combustion space 21. The flame burns in this space. The cylindrical shell of the flame retention baffle 11 consists of at least one perforated plate, but advantageously of at least two perforated plates fitted into one another, namely an outer perforated plate 24 and an inner perforated plate 25. The openings in these perforated plates 24, 25 may be circular or elongated, that is to say, for example, they may be designed as slots. Other shapes are also possible. The openings of the two perforated plates 24, 25 may be of different size. For example, the holes in the outer perforated plate 24 may be smaller than those in the inner perforated plate 25. The hole pattern may also have different dimensions. In addition, it may be advantageous for the size of the openings to be varied, for example by the openings in the bottom region facing the vaporizing chamber 17 being larger and by the size of the openings decreasing toward the top, that is in the direction of the cover 35. The cylinders formed from the two perforated plates 24, 25 may be pushed directly one inside the other, but there may also advantageously be a more or less large gap between them. Small component flames, which together form a very stable flame carpet, burn at the openings of the outer perforated plate 24. The inner perforated plate 25 brings about a further improvement in the mixing of fuel and air. This also achieves the effect that the inner perforated plate 25 has a markedly lower temperature than the outer perforated plate 24. To a very large extent, this measure rules out the possibility of a flashback of the flame into the interior of the flame retention baffle 11. The designs of the flame retention baffle 11 which have been specified also have the advantage that the flame burns very uniformly, which also manifests itself in a low noise level.

The deflection collar 12 surrounding a part of the flame retention baffle 11 does not extend with its cylindrical part 12*a* down to the base of the burner pot 5 (FIG. 1) but is held in the burner pot 5 at the bottom by means of, for example three legs (not shown). The inclined shoulder 12*b* of the deflection collar 12 does not extend up to the cylindrical shell of the flame retention baffle 11. On the contrary, an annular gap 34 remains open in between.

Arranged below the flame retention baffle 11 in the vaporizing chamber 17 is a perforated disk 27 which lies parallel to the base 19 of the vaporizing chamber 17. A mixing wheel 28, which is fastened to the drive shaft 14, is located between this perforated disk 27 and the base 19. This mixing wheel 28 therefore rotates together with the rotors 15, 16. A baffle plate 29 is arranged below the mixing wheel 28. Further below, a conical atomizer cup 30 is connected to the drive shaft 14, and an end 31 of a fuel line 32 projects into the interior space of this atomizer cup 30. Since the baffle plate 29 and the atomizer cup 30 are also fastened to the drive shaft 14, these parts rotate together with the rotors 15, 16 and the mixing wheel 28. For the sake of completeness, it may be mentioned that an annular seal 33 lies between the base 19 and the housing of the fan 3 lying underneath (FIG. 1).

The mode of operation of the burner 1 will now be described below. In this case, a state in which the burner 1 is switched off and has cooled down to the greatest possible extent is taken as a basis. From a master heating controller or boiler controller, a command is now transmitted to the burner control unit to the effect that the burner 1 is to be switched on. The procedure for the start-up corresponds to the known prior art. According to the invention, provision is now made for the burner control unit to first of all switch on the electric heating device 20. The vaporizing chamber 17 is thus heated by means of external energy. The parts connected to the drive shaft 14, such as rotors 15, 16, mixing wheel 28, baffle plate 29 and atomizer cup 30, rotate by switching on the fan 3. After a pre-ignition time has expired, a delivery pump which delivers the heating oil to be burned from a tank into the burner 1 is started.

The start-up of the delivery pump now causes heating oil to be delivered through the fuel connection 7 (FIG. 1) into the fuel line 32, where it discharges at the end 31 of the latter. The heating oil delivered flows or drops onto the inner wall of the atomizer cup 30. On account of the rotation of the atomizer cup 30, the heating oil flows under the effect of the centrifugal force toward the top rim of the atomizer cup 30, is thrown off the rim and strikes the inner wall of the vaporizing chamber 17. At the same time, fresh air is delivered by the rotors 15, 16 of the fan 3 and strikes the atomizer cup 30 from below. In the process, the fresh air flows on the outside along the atomizer cup 30, on the one hand, but, on the other hand, also flows through openings in the base of the atomizer cup 30 through the interior of the atomizer cup 30 toward the baffle plate 29. Both partial flows then flow around the mixing wheel 28 and the baffle plate 29. This is indicated by arrows in FIG. 2. Depending on the heat requirement, the rotary speed of delivery pump is lower or higher, the rotary speeds of delivery pump and fan 3 being matched to one another so that the quantities of fuel and air are matched to one another in such a way that as far as possible complete combustion takes place. If the delivery pump is not a gear pump, for example, but rather a piston pump, another variable characterizing the delivery volume takes the place of the rotary speed. It is essential that the volumes of air and fuel delivered are in the correct ratio.

The vaporizing chamber 17 is preheated by the effect of the electric heating device 20, so that the heating oil, which is already finely distributed by the atomization, is vaporized here and at the same time intensively mixed with the fresh air flowing through. The combustible mixture of heating-oil vapor and air, which mixture is of approximately stoichiometric composition as a result of matched rotary speeds of delivery pump and fan 3, now enters the interior space of the flame retention baffle 11, a fact which is likewise identified by arrows in FIG. 2. This mixture then passes through the holes in the perforated plates 24, 25. The ignition is switched on at the suitable moment by the burner control unit. The ignition electrode 9 is energized and ignites the combustible mixture. A cohesive flame now burns at the lateral surface of the flame retention baffle 11 and the hot exhaust gases flow into the combustion space 21. The combustion space 21 is surrounded by the heat exchanger of the heating boiler, a factor which is not shown in FIGS. 1 and 2.

According to the invention, provision is now made for a part of the flow of the hot exhaust gases to be diverted by suitable means in such a way that they heat the vaporizing chamber 17 from outside. In FIGS. 1 and 2, these means are shown in the form of the deflection collar 12. Other embodiments having the same effect are possible within the scope of the invention. Those hot exhaust gases which arise at the flame retention baffle 11 in the space surrounded by the deflection collar 12 are directed downward by the deflection collar 12, a fact which is again identified by arrows in FIG. 2. The hot exhaust gases therefore act from outside on the vaporizing chamber 17 and heat up the latter. According to the invention, therefore, further operation of the electric heating device 20 is unnecessary. The temperature sensor 8 is advantageously mounted on the burner pot 5 (FIG. 1). This temperature sensor 8 determines whether the temperature required for vaporizing the heating oil, at least 350 degrees Celsius in the case of extra light heating oil, is reached in the burner pot 5 and thus at the vaporizing chamber 17. The temperature sensor 8 therefore determines the actual value of the temperature and transmits this measured value to the burner control unit, which compares the actual value of the temperature with the desired value and which switches off the electric heating device 20 if the actual value is higher than the desired value.

The temperature sensor 8 together with the burner control unit and the electric heating device 20 may also act in such a way that the electric heating device 20 is not only switched off when a certain temperature is reached, but that the temperature in the vaporizing chamber 17 is actually controlled, e.g. according to a PID algorithm. This may be of advantage if the burner is used in an extremely cold zone.

It would actually also be possible to switch off the electric heating device 20 for a certain time, for example an adjustable time, after the appearance of the flame. However, the solution with the switch-off controlled by the temperature sensor 8 is advantageous with regard to operating safety and efficiency. The electric heating device 20 is thus also automatically switched off in adaptation to the effective heating output of the burner 1 if the latter is operated in a modulating manner, that is with lower or higher output.

The portion of the hot exhaust gases which is used for heating the vaporizing chamber 17 can be determined by the dimensioning of flame retention baffle 11 and deflection collar 12. The annular gap 34 ensures that there is a continuous flame at the lateral surface of the flame retention baffle 11. The openings in the perforated plates 24, 25, which correspond in function to the perforated flame plate described in DE-A1-25 34 066, also achieve the effect that the flame burns in a stable manner and cannot flash back.

The device according to the invention ensures that the temperature required for complete vaporization of the heating oil prevails in the vaporizing chamber 17, so that a situation can be ruled out in which the heating oil carbonizes and contaminates the burner 1 and makes it susceptible to faults.

In addition, the large lateral surface of the flame retention baffle 11 has the advantage that a flame of large area is produced, the temperature of which is lower than in burners according to the prior art. This has an advantageous effect, because fewer nitrogen oxides NOx are produced in the burner according to the invention. It is also advantageous that only small pressure differences, on both the fuel side and the air side, are necessary in such a burner 1, a factor which, in a positive manner, manifests itself in a low noise level. The burner 1 according to the invention can therefore also be used in multiple-stage heating systems without problem, where gas burners are otherwise preferred on account of the low noise level specific to this type of burner.

In connection with the burner 1 according to the invention, different designs of pump can be used for the delivery of the heating oil, for example piston or gear pumps, since no pressure atomization of the heating oil is necessary, which would require high oil pressures.

Figure 3:
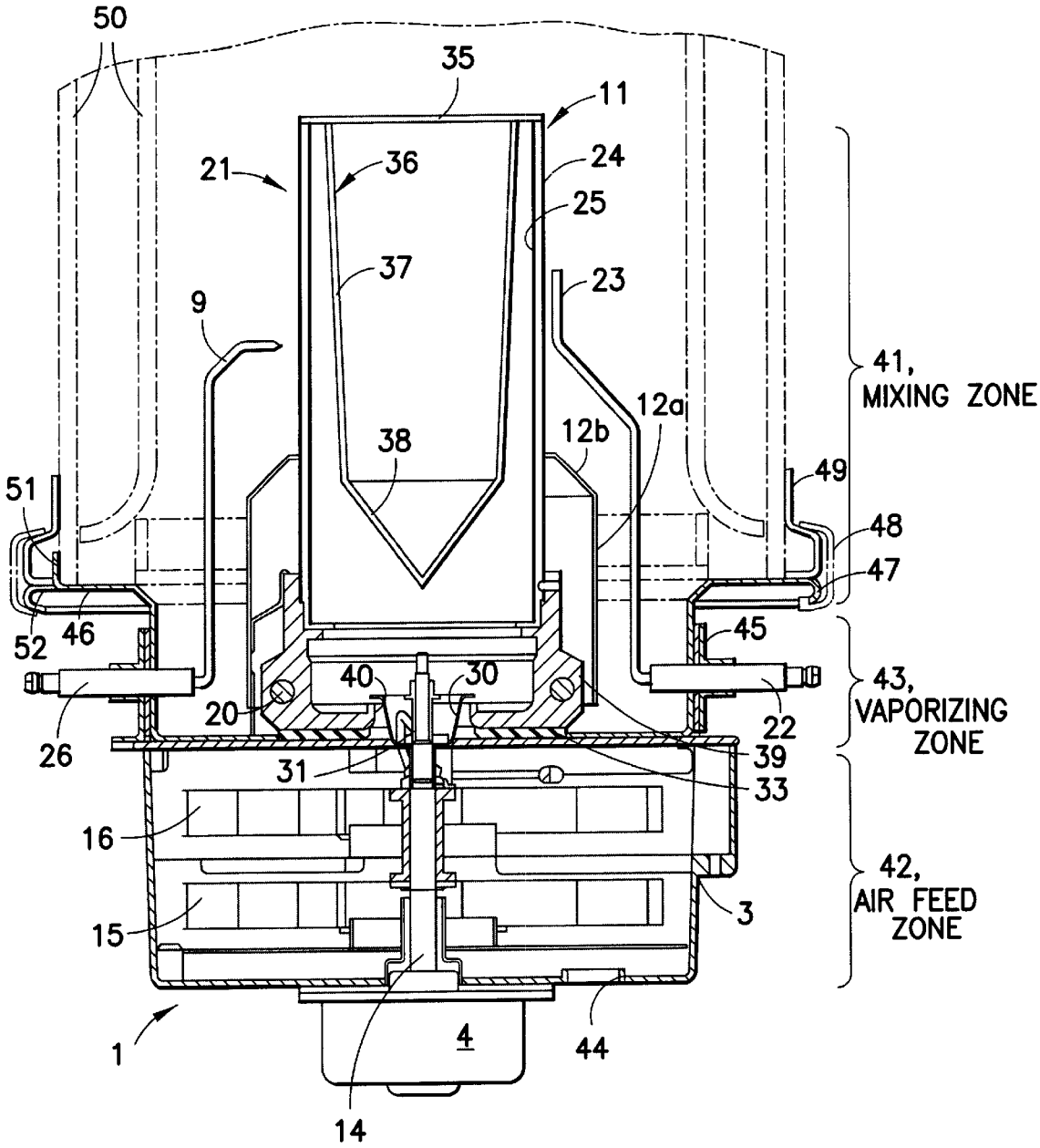
FIG. 3 shows the same section of a second embodiment.

A vertical section of a second embodiment is shown in FIG. 3. In this case, the same parts are provided with the same reference numerals. In this exemplary embodiment, an insert 36, which is made of heat-resistant steel sheet, is advantageously arranged centrally in the interior space of the flame retention baffle 11. The insert 36 is rotationally symmetrical and consists of a frustoconical top part 37 and an adjoining conical bottom part 38. As in the previous exemplary embodiment, the fuel/air mixture in this variant also flows from below into the interior space of the flame retention baffle 11. The volume filled by the fuel/air mixture in the interior of the flame retention baffle 11 is reduced by the insert 36, and the shaping of the insert 36 achieves the effect that the effective cross section in the flame retention baffle 11 decreases from bottom to top. The result of this measure is that the dead volume in the flame retention baffle 11 is smaller and that the average flow velocity increases, as a result of which the dwell time of the fuel/air mixture in the interior of the flame retention baffle 11 is reduced. These measures also result in a further reduction in the self-ignition tendency inside the flame retention baffle 11, despite the heating taking place during burner operation. Even during prolonged full-load operation, flashback of the flame is thus prevented. The described shaping of the insert 36 is only to be understood as an example. Other embodiments, for example with a parabolic profile, are advantageously possible within the scope of the invention.

Furthermore, FIG. 3 shows a different design in the interior of the vaporizing chamber, which here, unlike FIG. 2, is provided with the reference numeral 39. This embodiment also differs from that according to FIG. 2 owing to the fact that there is no baffle plate 29, mixing wheel 28 or perforated disk 27. This results in a modified preparation of the fuel/air mixture. From the rotating atomizer cup 30, the heating oil is thrown by the effect of the centrifugal force against the inner wall of the vaporizing chamber 39, whereupon it vaporizes there. The vaporized heating oil is carried along by a first partial flow of the air delivered by the fan 3 (FIG. 1), the air being passed through a gap 40 along the outside of the atomizer cup 30, the partial flow of the air and the vapor of the heating oil being mixed. At the same time, this partial flow of the air is heated in the vaporizing chamber 39. A second partial flow flows from the fan 3 (FIG. 1) through the interior of the atomizer cup 30, also open at the bottom in this case, and remains unheated and thus does not cool the vaporizing chamber 39. The two partial flows combine above the atomizer cup 30, so that it is not until here that complete mixing of fuel and air takes place. An air feed zone 42, a vaporizing zone 43 and a mixing zone 41 can therefore clearly be differentiated in the burner 1. Whereas the air feed zone 42 is formed by the fan 3, the vaporizing zone 43 comprises the atomizer cup 30 and the interior space of the vaporizing chamber 39. The actual mixing zone 41 is formed here by the interior space of the flame retention baffle 11, the intermixing of fuel and air also being improved by virtue of the fact that there is a clear distance between the outer perforated plate 24 and the inner perforated plate 25 in this exemplary embodiment.

In contrast to the example of FIG. 1, the air is not fed to the fan via a connection tube 10 but rather can flow in from the immediate surroundings of the burner 1 via an opening 44 in the housing of the fan 3. However, a connection tube 10 (FIG. 1) may also be provided.

In addition, FIG. 3 shows in more detail how the burner 1 can be fastened to a heating boiler 50. The burner pot, provided with the reference numeral 5 in FIG. 1, is designated here by the reference numeral 45. At its top end, the burner pot 45 has a flange 46, the outer end 47 of which is bent over downward. A clamping ring 48 encloses the outer end 47 of the burner pot 45 and at the same time an extension 49 on the heating boiler 50. In addition, by way of an example, the left-hand side of FIG. 3 shows how the fastening of the burner 1 to the heating boiler 50 is designed such that it can be positioned in a clearly defined manner. A tab 51 is bent upward from the outer end 47 of the flange 46, and this tab 51 engages in a recess 52 in the extension 49 of the heating boiler 50.

Figure 4:
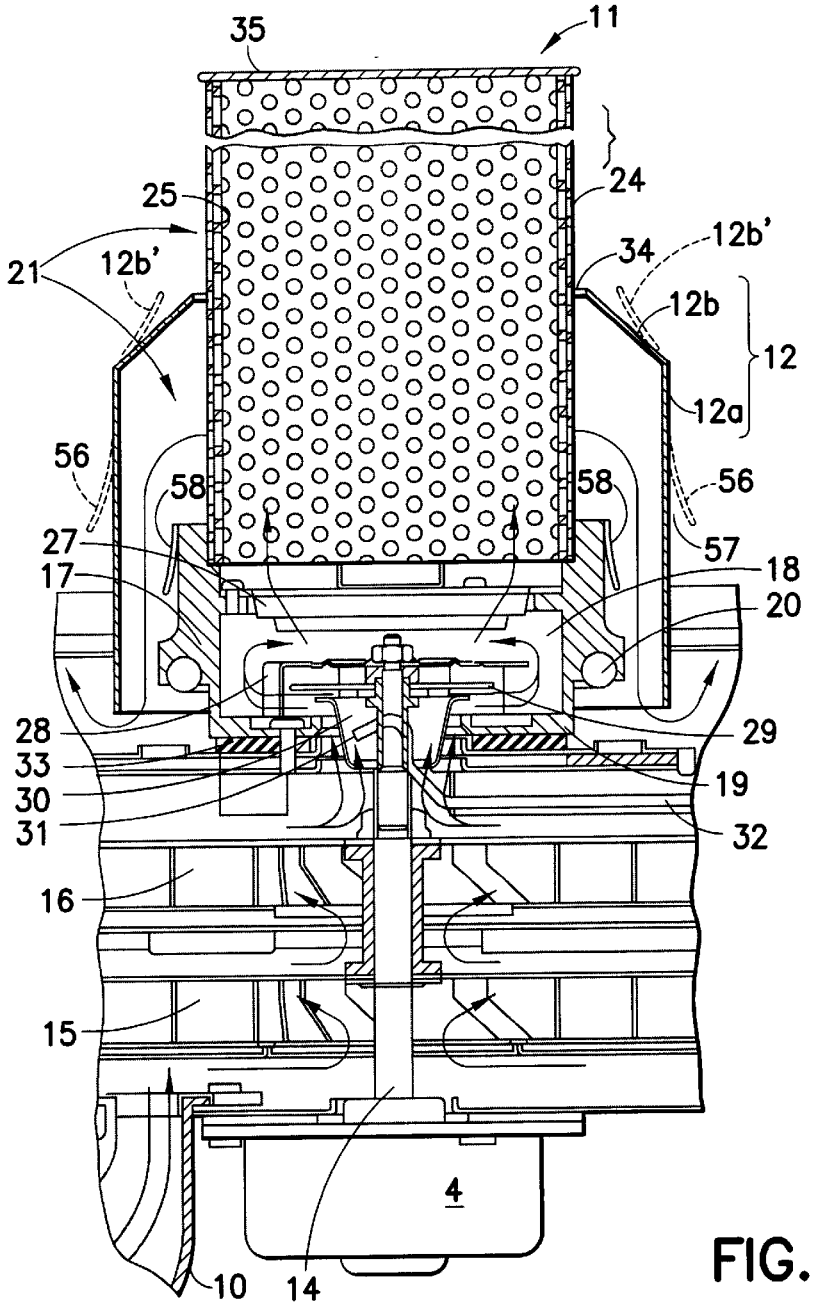
FIG. 4 shows a vertical section with alternative embodiment variants.

Shown in FIG. 4 are alternative embodiment variants with which, according to the invention, it is possible to influence that partial flow of the hot exhaust gases with which, as mentioned in the explanation of FIG. 2, the vaporizing chamber 17 can be heated from outside. It has been found to be advantageous if there are means of influencing this partial flow in order to keep the temperature of the vaporizing chamber 17 approximately constant under all load conditions. The first embodiment variant relates to the design of the inclined shoulder 12*b* of the deflection collar 12. This shoulder 12*b* is advantageously made of a thermal bimetal, so that, with a change in temperature, it changes its shape by virtue of the fact that it arches. A second position which can be achieved by such a change in temperature is shown in FIG. 4 by the reference numeral 12*b*'. Due to this change in shape, the width of the annular gap 34 changes during a change in temperature, a factor which has an effect on the size of the partial flow of the hot exhaust gases.

Figure 5:
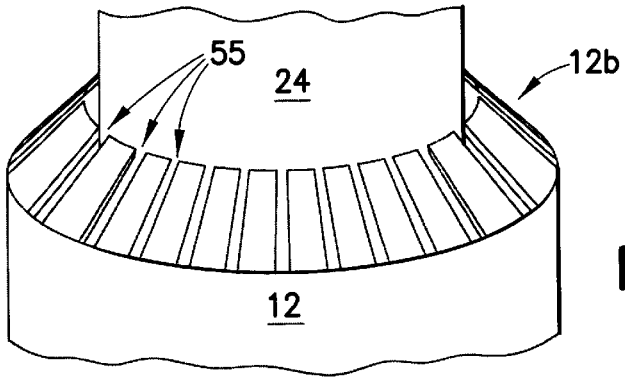
FIG. 5 shows a view of a detail.

So that the inclined shoulder 12*b* of the deflection collar 12 can form this arching as far as possible without hindrance, it is advantageous if it is slotted. The inclined shoulder 12*b* which has slots 55 is shown in FIG. 5.

A second variant for influencing the partial flow of the hot exhaust gases consists in the fact that a section 56 of the cylindrical part 12*a* of the deflection collar 12 is made of thermal bimetal. When this section 56 arches due to the effect of heat, a discharge opening 57 through which a portion of the partial flow of the hot exhaust gases can escape again is obtained in the cylindrical part 12*a*, so that said portion can have no thermal effect on the vaporizing chamber 17. Thus, when the exhaust gases are very hot, the vaporizing chamber 17 is heated to a less pronounced extent. In order to enable the section 56 to arch as far as possible without hindrance, this section 56 is likewise slotted.

A third variant consists in the fact that a collar 58, which is likewise made of thermal bimetal, is placed around the outer lateral surface of the vaporizing chamber 17. This collar 58 also arches under the effect of heat. The size of the free cross section between the vaporizing chamber 17 and the cylindrical part 12*a* of the deflection collar 12 is thus changed, which has a direct effect on that partial flow of the hot exhaust gases which thermally influences the vaporizing chamber 17.

The various embodiment variants described above may also be combined. Thus, for example, the insert 36 may also be used in the second embodiment according to FIG. 3.

A spiral (not shown in the figures) which concentrically encloses the flame retention baffle 11 may advantageously be arranged in the combustion space 21 surrounding the flame retention baffle 11, this spiral having the task of dissipating heat from the flame. This measure achieves the effect that the flame temperature becomes lower, which advantageously manifests itself in a lower content of nitrogen oxides $NO_x$.

The variants of the burner 1 which are described above can be modulated in a ratio of 1:3, so that the output of the burner 1 can be controlled, for example, between 5 and 15 kW.

What is claimed is:

1. A burner for liquid fuel comprising:

a burner pot including a vaporizing chamber;

an atomizing element in the vaporizing chamber for atomizing liquid fuel;

an electric heating device for start up heating said vaporization chamber to therewith vaporize the atomized fuel therein;

a cylindrical flame retention baffle on the vaporizing chamber, the retention baffle having a lateral surface with holes therein;

a fan for supplying an air flow through said vaporizing chamber for mixing of heated vaporized fuel in said air flow and delivery of a combustible fuel/air mixture into said retention baffle, a flame forming outside the retention baffle at the lateral surface of said retention baffle when the combustible mixture is ignited producing a flow of hot exhaust gases;

means for deflecting a portion of said hot exhaust gas flow in a flow direction to heat the vaporizing chamber from an outside thereof to provide a desired temperature value of at least 350° C. in said vaporization chamber, and a temperature sensor attached to a wall of said burner pot for sensing a temperature in said vaporizing chamber and outputting a signal of sensed temperature value so that when a temperature in said vaporizing chamber exceeds said desired temperature value said electric heater can be switched to a non-operating state.

2. A burner according to claim 1, wherein said deflecting means comprises a deflection collar encircling at least a part of said retention baffle.

3. A burner according to claim 2, wherein said retention baffle is cylindrical, and the deflection collar concentrically encloses said retention baffle, one end of said baffle being on said vaporization chamber.

4. A burner according to claim 3, wherein said atomizing element is an atomizing cup, means for splitting said air flow into first and second air flow paths upstream of said vaporizing chamber, said first air flow path passing into said vaporizing chamber at an exterior side of said atomizing cup, said second air flow path into said vaporizing chamber through said atomizing cup.

5. A burner according to claim 3, wherein the lateral surface of said retention baffle is that of a perforated member, and a cover closing an end of said retention baffle remote from said vaporization chamber.

6. A burner according to claim 5, wherein a second perforated member is disposed inside the first-mentioned perforated member.

7. A burner according to claim 6, wherein perforations of the second perforated member are smaller than perforations of the first-mentioned perforated member.

8. A burner according to claim 1, wherein the flame retention baffle is one of a heat-resistant steel sheet and a ceramic.

9. A burner according to claim 3, wherein the deflector collar has an inclined shoulder part which encircles the lateral surface of said flame retention baffle with an annular gap therebetween, and a cylindrical part extending from the inclined shoulder to a base part of the burner pot.

10. A burner according to claim 9, comprising means for altering a size of the annular gap responsive to a hot exhaust gas temperature change therewith to influence the hot exhaust gas flow portion heating the vaporization chamber as a function of hot exhaust gas temperature.

11. A burner according to claim 10, wherein said means for altering is a thermal bimetal deflection collar inclined shoulder part the shape of which changes as a arching thereof responsive to temperature change therein.

12. A burner according to claim 11, wherein said deflector collar inclined shoulder includes spaced slots therein to facilitate arching thereof.

13. A burner according to claim 9, wherein the cylindrical part of the deflection collar includes means for influencing the hot exhaust gas flow portion heating the vaporization chamber as a function of hot exhaust gas temperature.

14. A burner according to claim 13, wherein said means for influencing is at least one thermal bimetal moveable section in said cylindrical part which arches away from said cylindrical part responsive to temperature change thereby defining a discharge opening in said cylindrical part for escape of some part of the hot exhaust gas heating the vaporization chamber so that said some hot gas flow part has no thermal influence on the vaporization chamber.

15. A burner according to claim 3, comprising a collar of thermal bimetal extending around an outer lateral surface of said vaporization chamber, said thermal bimetal collar arching away from said vaporization chamber responsive to a temperature change therein for changing a size of a free cross section between said vaporization chamber and the deflection collar cylindrical part and therewith influencing the hot exhaust gas flow portion heating the vaporization chamber as a function of hot exhaust gas temperature.

16. A burner according to claim 3, comprising a rotationally symmetrical insert disposed centrally in an interior space of the flame retention baffle for decreasing an effective cross section of said interior space in a direction from said one end of said baffle to an opposite baffle second end.

17. A burner according to claim 16, wherein said insert includes a conical part proximal said baffle one end, and an adjoining frustoconical part extending to said baffle opposite second end.

* * * * *